United States Patent [19]

Larson

[11] Patent Number: 4,598,795

[45] Date of Patent: Jul. 8, 1986

[54] LADDER HOIST ATTACHMENT

[76] Inventor: Kevin Larson, 6760 W. 32nd Ave., Wheat Ridge, Colo. 80033

[21] Appl. No.: 747,561

[22] Filed: Jun. 21, 1985

[51] Int. Cl.[4] ..... E06C 7/12; E06C 7/00

[52] U.S. Cl. ..... 182/129; 182/214; 248/210; 254/389

[58] Field of Search ..... 182/214, 102, 103, 145, 182/129, 117, 142; 248/210; 254/389, 393

[56] References Cited

U.S. PATENT DOCUMENTS

| | | | |
|---|---|---|---|
| 218,929 | 8/1879 | Cavanagh | 182/102 |
| 543,513 | 7/1895 | Somers | 182/214 |
| 731,708 | 6/1903 | Quinn | 182/116 |
| 799,782 | 9/1905 | Ellinger | 182/214 |
| 1,115,420 | 10/1914 | Farnham | 248/210 |
| 2,319,893 | 5/1943 | Tuttle | 254/139 |
| 2,407,541 | 9/1946 | Ehnborn | 182/214 |
| 2,432,189 | 12/1947 | Bucher | 182/214 |
| 2,459,621 | 1/1949 | Cobb | 248/210 |
| 2,628,071 | 2/1953 | Williams | 254/195 |
| 2,755,010 | 7/1956 | Ebbo | 182/214 |
| 2,803,389 | 8/1957 | Munson | 182/129 |
| 2,908,345 | 10/1959 | Lund | 182/214 |
| 3,743,227 | 7/1973 | Sowery | 248/210 |
| 4,164,269 | 8/1979 | Jackson | 182/229 |
| 4,331,217 | 5/1982 | Stecklow | 182/214 |

*Primary Examiner*—Reinaldo P. Machado

[57] ABSTRACT

A ladder hoist attachment consists of a boom and prop combination that allows a conventional ladder to be used to hoist heavy loads. The boom assembly consists of a number of feet that removably attach to a rung of the ladder; a boom that extends horizontally over the top rung of the ladder; and braces connecting the feet and boom that also rest against the top rung of the ladder. One end of the prop removably attaches to a lower rung of the ladder. The other end of the prop has a vertical step to hold the ladder at a predetermined distance away from the edge of the roof. A winch or pulley is suspended from the end of the boom extending over the top rung of the ladder to allow loads to be lifted through the prop and between the ladder and the building. After the load has been lifted above the height of the roof, the end of the prop against the building is lifted by the user to allow the ladder to be moved to rest against the edge of the roof, thus allowing the load to be lowered on to the roof.

4 Claims, 4 Drawing Figures

LADDER HOIST ATTACHMENT

BACKGROUND OF THE INVENTION

The present invention relates generally to hoists for lifting loads. More specifically, the present invention consists of a lightweight, portable boom and prop that can be used in association with virtually any ladder to lift loads. This apparatus is especially suitable for use in lifting loads on to the roof of a building in the construction, roofing, or air conditioning trades.

The prior art contains several references showing various types of pulley arrangements fastened or attached to a ladder to raise or lower loads, e.g., U.S. Pat. Nos. 3,743,227; 2,803,389; 2,628,071; 2,459,621; 2,319,893; 799,782; and 731,708. The prior art also discloses various brackets, props, or supports to secure and hold a ladder away from the wall or roof of a building, e.g., U.S. Pat. Nos. 4,331,217; 4,164,269; 2,432,189; 2,407,541; and 543,513. The primary differences between the prior art and the present invention involve the specific structure of the boom and prop that allows the apparatus to be more compact, lightweight, portable, and adaptable to a variety of ladders that the prior art references. With the present invention, the boom assembly and prop can each be easily carried up the ladder, put in place, and used by a single person. In contrast, the apparatus disclosed in U.S. Pat. No. 2,803,389, has both a variety of boom and a support to hold the ladder away from the building. However, this apparatus is far more bulky and cumbersome to carry up the ladder and to use.

SUMMARY OF THE INVENTION

The present invention is a combination of a boom and a prop used with a conventional ladder to hoist loads. The boom assembly has a number of feet that removably secure the assembly to one of the lower rungs of the ladder. A number of braces extend from these feet to a boom that extends horizontally over the top rung of the ladder. At least one of these braces rests against the top rung of the ladder to provide support for the boom. A pulley or a winch is attached to the end of the boom extending over the top rung of the ladder to facilitate lifting of loads.

One end of the prop is removably secured to one of the lower ladder rungs. The other end of the prop has a vertical step to catch the edge of the roof, and hold the ladder away from the edge of the roof. The load is lifted by means of the pulley or winch through the prop, and between the ladder and the edge of the roof. The end of the prop against the building is then lifted by the user and controlled to allow the ladder to gradually move to rest against the edge of the roof. The load can then be lowered onto the roof.

One principal object of the present invention is to provide a lightweight, portable apparatus for lifting loads, particularly in the construction, roofing, and air conditioning industries. A second object is to provide an apparatus that can readily be used with virtually any ladder regardless of size, with little or no training.

DETAILED DESCRIPTION OF THE INVENTION

Figure 1:
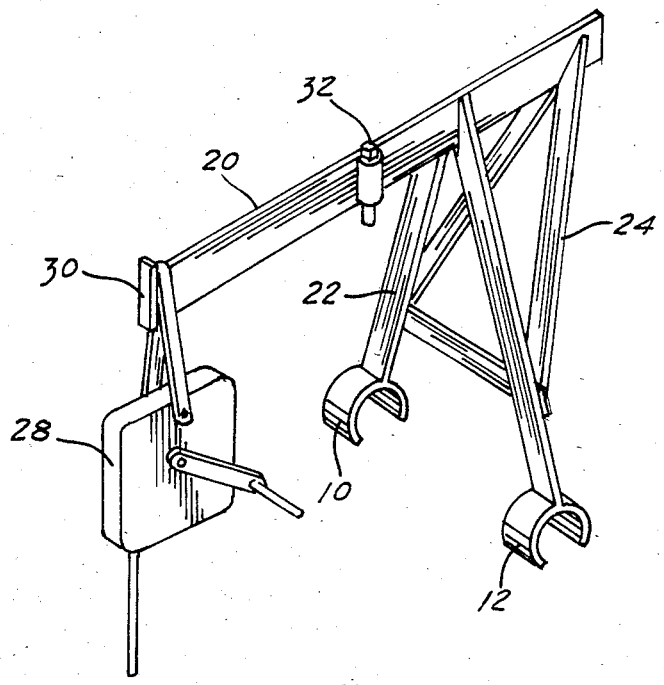
FIG. 1 is a perspective view showing the boom assembly.
Figure 3:
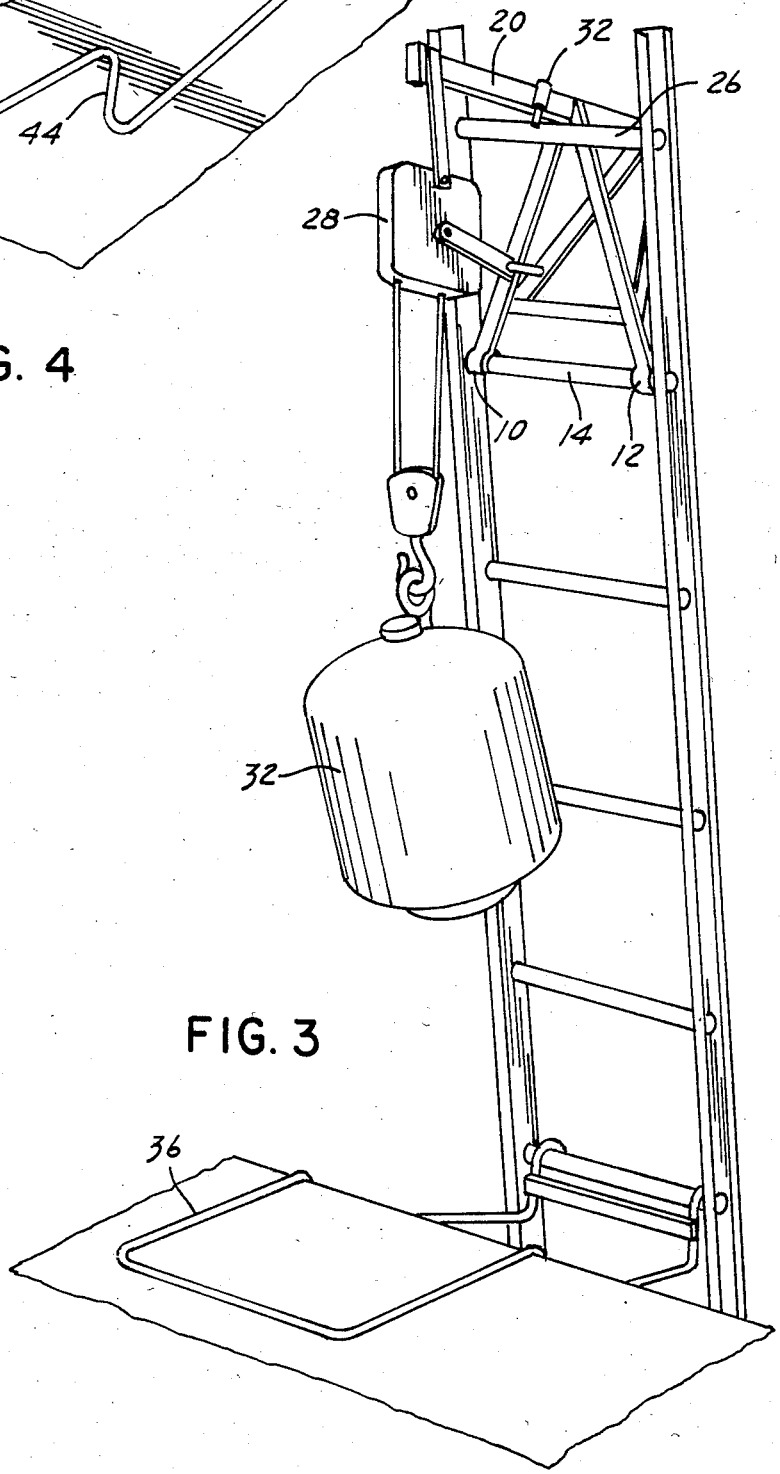
FIG. 3 is a perspective view showing the boom and prop attached to the ladder. A winch is shown attached to the end of the boom, lifting a load.

Turning to FIG. 1, the boom assembly is shown in perspective view. FIG. 3 more clearly shows the manner in which the boom assembly is attached to the ladder. A number of feet, 10 and 12, are used to hold one of the lower rungs 14 of the ladder. In the preferred embodiment, these feet can be fabricated with a "C" shape from short sections of pipe or tubing. To attach the boom assembly, the feet easily slip over the rung of the ladder. However, once in place, the feet resist any lateral forces or momements created by the boom or the load being lifted.

A number of triangular braces 22 and 24 connect the feet with the boom 20. The boom extends over the top rung 26 of the ladder, as shown in FIG. 3. The forwardmost set of braces 22 rest against the top rung of the ladder. Additional braces 24 can be added for increased structural support and rigidity.

A winch or pulley 28 is suspended from the end of the boom to aid in lifting the load 32. A stop 30 is provided at the end of the boom to hold the pulley in place. A pin 32 holds the boom assembly in place with respect to the top rung of the ladder, as shown in FIG. 3, to prevent the boom assembly from accidentally being pushed backward over the ladder and injuring people at the base of the ladder.

Figure 2:
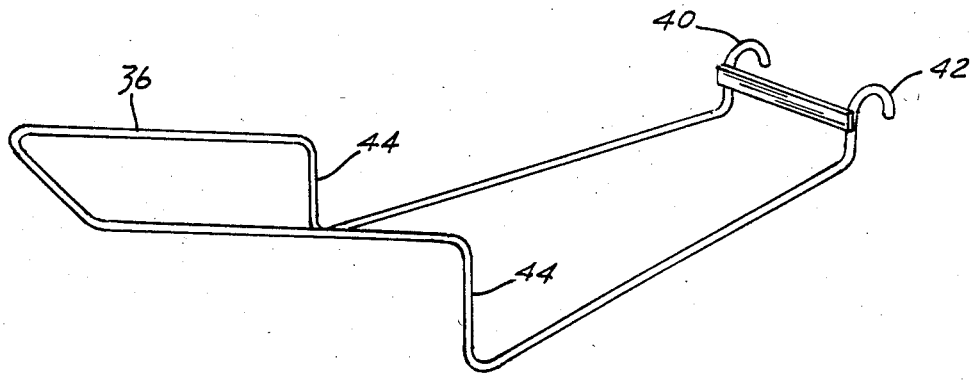
FIG. 2 is a perspective view showing the prop.
Figure 4:
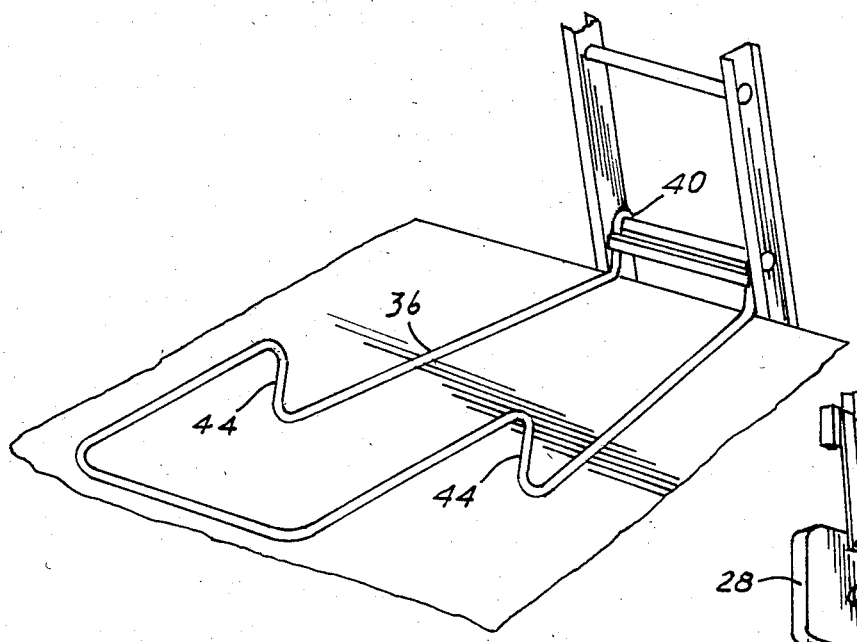
FIG. 4 is a perspective view showing the prop and a section of the ladder to illustrate the manner in which the end of the prop is lifted to allow the ladder to rest against the edge of the roof.

The prop is shown in FIGS. 2–4. One end of the prop has feet or hooks 40 and 42 that slip over one of the lower rungs of the ladder. The prop also has a vertical step at a predetermined length from the feet. This step is used to hold the corner of the roof and thereby separate the ladder from the building as shown in FIG. 3. A load 32 can be raised or lowered by means of the pulley or winch 28. The spacing between the arms of the prop allows the load to pass freely between the arms, and between the building and the ladder. The prop is fabricated by bending a single rod. The arms of the prop can be bent or bowed outward to provide increased latteral spacing to accomodate wider loads.

After the load has been lifted through the prop and is above the level of the roof, the user simply lifts the end of the prop extending over the edge of the roof to allow the ladder to move to rest against the building as shown in FIG. 4. This moves the pulley and load forward over the roof where the load may be deposited.

I claim:

1. A ladder hoist attachment comprising:

(a) A prop having a number of feet for removably securing the prop to a rung of the ladder; a number of elongated members extending horizontally from said feet, each of said members having a vertical step at a predetermined length from said feet;

(b) A boom assembly comprising a number of feet that removably attach to a rung of the ladder; a boom extending horizontally over the top rung of the ladder; and a number of braces connecting the feet and boom, the foward most brace resting against the top rung of the ladder.

2. The ladder hoist attachment of claim 1 wherein the boom feet comprise "C" shaped members having an opening sufficiently large to slip over a rung of the ladder.

3. The ladder hoist attachment of claim 1 further comprising a winch attached to the end of the boom.

4. A ladder hoist attachment comprising:

(a) A prop having a number of feet for removably securing the prop to a rung of the ladder; a number of elongated members extending horizontally from said feet, each of said members having a vertical step at a predetermined length from said feet;

(b) A boom assembly comprising a number of feet that removably attach to a rung of the ladder; a boom attaching horizontally over the top rung of the ladder; and a number of braces connecting the feet and boom, the forward-most brace resting against the top rung of the ladder; and (c) a pin that may be inserted through a hole in the boom in front of the top ladder rung to prevent the boom assembly from accidentally falling backward off the ladder.

* * * * *